US005366206A

United States Patent [19]

Sawyer et al.

[11] Patent Number: 5,366,206

[45] Date of Patent: Nov. 22, 1994

[54] MOLTEN METAL SPRAY FORMING ATOMIZER

[75] Inventors: Thomas F. Sawyer, Stillwater; William T. Carter, Jr., Ballston Lake; Mark G. Benz, Burnt Hills, all of N.Y.

[73] Assignee: General Electric Company, Schenectady, N.Y.

[21] Appl. No.: 168,283

[22] Filed: Dec. 17, 1993

[51] Int. Cl.[5] ..... C23C 4/12

[52] U.S. Cl. ..... 266/202; 75/509

[58] Field of Search ..... 75/509; 266/202

[56] References Cited

U.S. PATENT DOCUMENTS

| | | | |
|---|---|---|---|
| 2,837,790 | 6/1958 | Roeian | 75/509 |
| 3,356,489 | 12/1967 | Feichtinger | 266/202 |
| 3,650,518 | 3/1972 | Moffat | 266/202 |
| 3,779,743 | 12/1973 | Olsson | 75/509 |
| 3,951,577 | 4/1976 | Okayama | 266/202 |
| 5,160,532 | 11/1992 | Benz | 266/202 |
| 5,196,049 | 3/1993 | Coombs | 266/202 |

*Primary Examiner*—Peter D. Rosenberg

*Attorney, Agent, or Firm*—R. Thomas Payne; James Magee, Jr.

[57] ABSTRACT

A molten metal atomization ring structure has an elongated or oval aperture therethrough through which a molten metal stream passes and is broken up into a molten metal spray pattern. The structure may be angularly adjusted about a transverse axis of the aperture at a greater angle without engaging the passing metal stream.

17 Claims, 2 Drawing Sheets

MOLTEN METAL SPRAY FORMING ATOMIZER

BACKGROUND OF THE INVENTION

This invention relates to an improved molten metal spray forming atomizer, and more particularly to such an atomizer particularly adapted for spray forming of a refined molten metal from a molten metal refining or melting chamber. A molten metal spray forming atomizer is employed to convert a small molten metal stream from the melt chamber into an expanding metal spray or plume of small molten metal droplets which impinge and deposit on an appropriate collector to provide a large metal billet or other object of desired metal characteristics.

One example of molten metal refining is referred to as electroslag refining, and is illustrated and described in U.S. Pat. No. 5,160,532—Benz et al, assigned to the same assignee as the present invention.

In an electroslag process, a large ingot of a preferred metal may be effectively refined in a molten state to remove important impurities such as oxides and sulfides which may have been present in the ingot. Simply described, electroslag refining comprises a metal ingot positioned over a pool of molten ingot metal in a suitable vessel or furnace where the molten metal pool includes a surface layer of solid slag, an adjacent underlayer of molten slag and a lowermost body of refined molten ingot metal. The ingot is connected as an electrode in an electrical circuit including the molten metal pool, a source of electrical power and the ingot. The ingot is brought into contact with the molten slag layer and a heavy electrical current is caused to flow across the ingot/molten slag interface. This arrangement and process causes electrical resistance heating and melting of the ingot at the noted interface with the molten ingot metal passing through the molten slag layer as a refining medium to then become a part of the body of refined ingot metal. It is the combination of the controlled resistance melting and the passage of molten ingot metal through the molten slag layer which refines the ingot metal to remove impurities such as oxides, sulfides, and other undesirable inclusions.

In metal spray forming, a small stream of refined molten metal from the furnace is caused to pass concentrically through a molten metal spray forming atomizer generally comprising a closed peripheral manifold about a central aperture. The manifold is equipped with gas inlet means and plural gas jet exit means. An inert gas under pressure is supplied to the manifold to exit through the gas jets in converging streams which impinge the passing metal stream to convert or break up the metal stream into a generally expanding spray pattern of small molten metal droplets. This spray pattern is caused to impinge and deposit on a suitable collector surface to generate a metal billet or other metal object.

Best results are obtained when the molten metal spray pattern from the atomizer is directed angularly against the collector or preform object rather than perpendicular. An angular impingement provides improved deposition efficiency as well as improved preform metal density and microstructure. However, some collector preforms are of a size and shape which require the spray pattern to be directed at greater angles and some means is required not only to convert a vertical molten metal stream to a spray pattern, but also to angularly direct or adjust the spray pattern at these greater angles for corresponding angular impingement against various collector preforms.

Accordingly, it is an object of this invention to provide an improved molten metal spray forming atomizer for a molten metal refining apparatus in which the manifold ring is non-circular to have a greater range of transverse angular rotation without interfering with the molten metal stream passing therethrough.

SUMMARY OF THE INVENTION

In a molten metal refining process a stream of molten metal is caused to pass concentrically through a spray forming atomizer. Plural gas jets from the atomizer converge on the passing metal stream to break up the stream into a spray pattern of small molten metal droplets for deposition on a collector or preform surface.

The atomizer ring is transversely angularly adjusted to angularly direct the metal spray pattern. Increased angular adjustment of the atomizer structure without interference with the passing molten metal stream is achieved with a non-circular, elliptical, for example, atomizer angularly adjusted about a minor axis of the atomizer configuration.

This invention will be better understood when taken in connection with the following drawings and description.

BRIEF DESCRIPTION OF A PREFERRED EMBODIMENT

Figure 1:
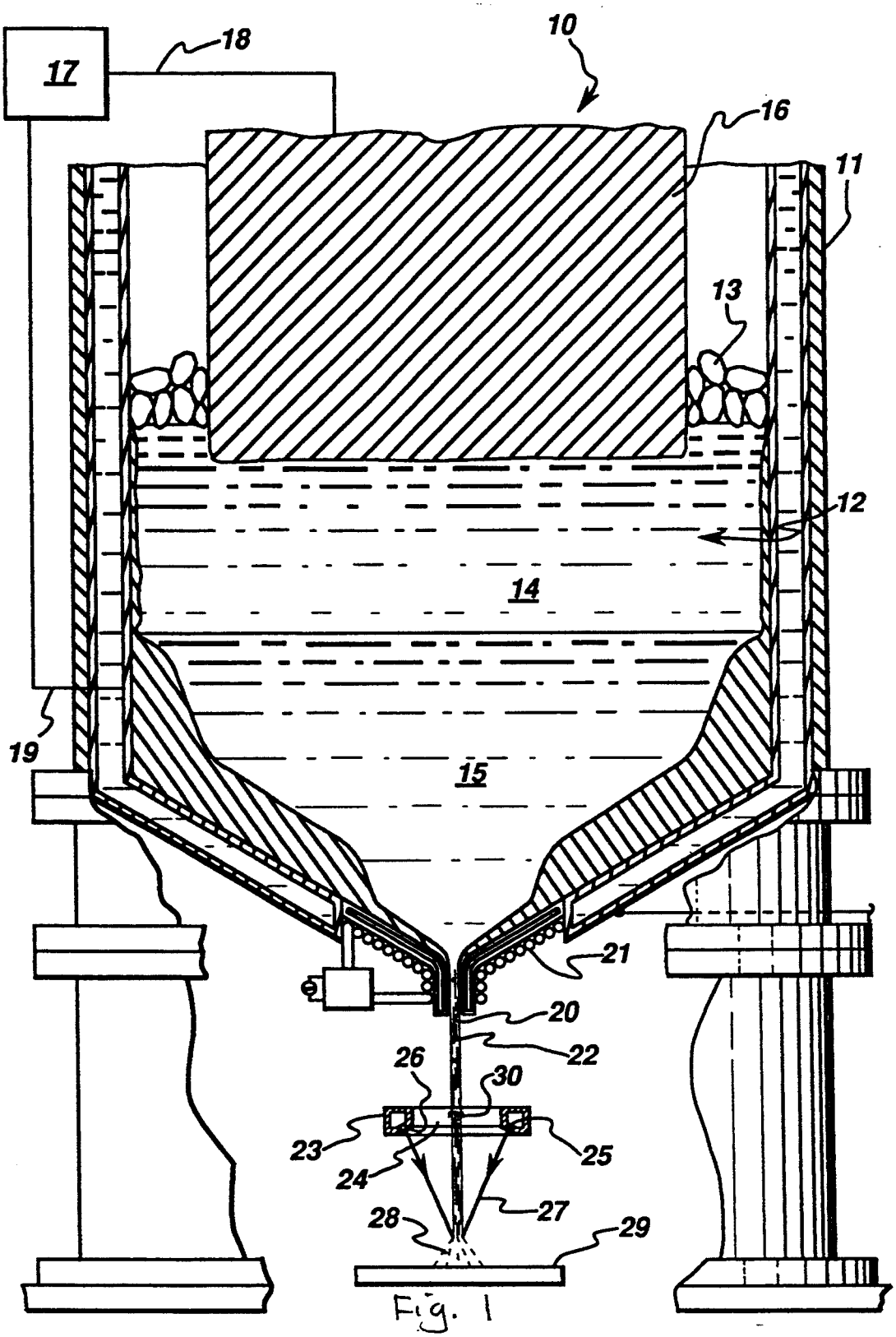
FIG. 1 is a partial and schematic illustration of an electroslag refining apparatus with its spray forming circular ring atomizer.

One example of molten metal refining equipment to which this invention may be advantageously applied is electroslag refining as illustrated in FIG. 1.

Referring now to FIG. 1 an electroslag assembly 10 comprises a melting vessel or furnace 11 containing, during operation of assembly 10, a resultant metal supply 12 of ingot metal. Supply 12 comprises a surface layer 13 of solid slag, an adjacent underlayer 14 of molten slag and a lowermost pool or body 15 of refined ingot metal. An ingot of a metal to be refined such as ingot 16 is brought into contact with molten slag layer 14. As illustrated in FIG. 1, ingot 16 is connected into an electric circuit as an electrode. Electrical power is supplied from a suitable power source 17 through a conductor 18 to ingot 16. An appropriate electrical conductor 19 from vessel 11 to source 17 completes the circuit. A heavy electrical current flowing across the interface of ingot 16 and molten slag 14 generates electrical resistance heating sufficient to cause melting of the interface end of ingot 16. Molten ingot metal passes through molten slag 14 as a refining procedure and becomes a part of refined metal pool 15.

At the lowermost part of vessel 11 a controlled drain orifice 20 communicates with molten metal pool 15. In order to ascertain melting and liquidity of molten metal 15 adjacent orifice 20, an electrical induction heating coil 21 surrounds orifice 20 and is connected to a suitable source of electrical power (not shown). By this means a stream of molten metal 22 is caused to flow from orifice 20 through a spray forming atomizer 23. In one form, atomizer 23 comprises a hollow circular ring manifold with a central circular aperture 24 which is concentrically positioned to receive metal stream 22 therethrough. Atomizer ring converter 23 also includes a peripheral row of gas jets or orifices 25 in a peripherally continuous tapered or conical edge surface 26. Atomizer 23 is connected to a source (not shown) of an inert gas under pressure, and the combination of the gas jet orifices 25 and conical surface 26 provides a plurality of gas streams 27 which converge at a downstream apex on the passing metal stream 22. The controlled interaction of the gas jet streams 27 with metal stream 22 causes metal stream 22 to break down and be converted to an expanding spray plume or pattern 28 of small molten metal droplets. Spray pattern 28 is directed against a collector 29 to provide, for example, a billet of refined ingot metal or other ingot metal objects. Collector 29 may be a fixed or moving surface including a rotating surface such as the surface of a rotating cylinder or mandrel. The efficiency and effectiveness of deposition of molten metal spray 28 on a collector surface to provide a refined metal object is facilitated and improved when the spray pattern 28 may be angularly adjusted with respect to the collector. Angular adjustment also leads to improved density and microstructure of the refined metal product. Continuous and repetitive angular adjustment may also be utilized to provide an oscillating or scanning motion of the converter. In order to provide angular adjustment, atomizer converter 23 may be mounted for angular adjustment rotation about a transverse axis so that the plane of the ring is not perpendicular to the metal stream 22. Also, by mounting atomizer 23 for angular adjustment rotation, the defined spray pattern 28 may be more advantageously matched to different surface configurations of collector 29 as compared to a non-adjustable ring where the spray pattern is fixedly directed to a limited area of the collector, a condition which may require a complex adjustable mounting of a collector which, for example, may weigh from 5.0 to 15 tons. One simple and convenient adjustable mounting for atomizer 23 may comprise a pair of diametrically opposed radially extending stub shafts 30 only one of which is shown in FIG. 1 with atomizer 23 therebetween.

There are definite limits to the degree of angular adjustment of atomizer 23. For example, metal stream 22 is a smooth cohesive stream passing concentrically through atomizer 23 with a predetermined ring clearance with respect to overall structure of atomizer 23 and its operating characteristics including the use of gas jets from orifices 25 or projecting nozzles. In one example metal stream 22 was about 5.0 mm. O.D., while atomizer 23 was about 30.0 mm. I.D. However, atomizer 23 is adjustable rotated about a transverse axis to an extreme angle, the ring body may approach too closely to the passing molten metal stream 22 or contact the stream and deleteriously affect metal spray generation.

In this invention, atomizer 23 is replaced with an atomizer having its defined aperture elongated and non-circular such as an elliptical or oval configuration. An elongated, ovate, or elliptical aperture provides an extended range of angular adjustment of atomizer 23 while maintaining a satisfactory central aperture exposure for the passing metal stream and spray forming.

Figure 2:
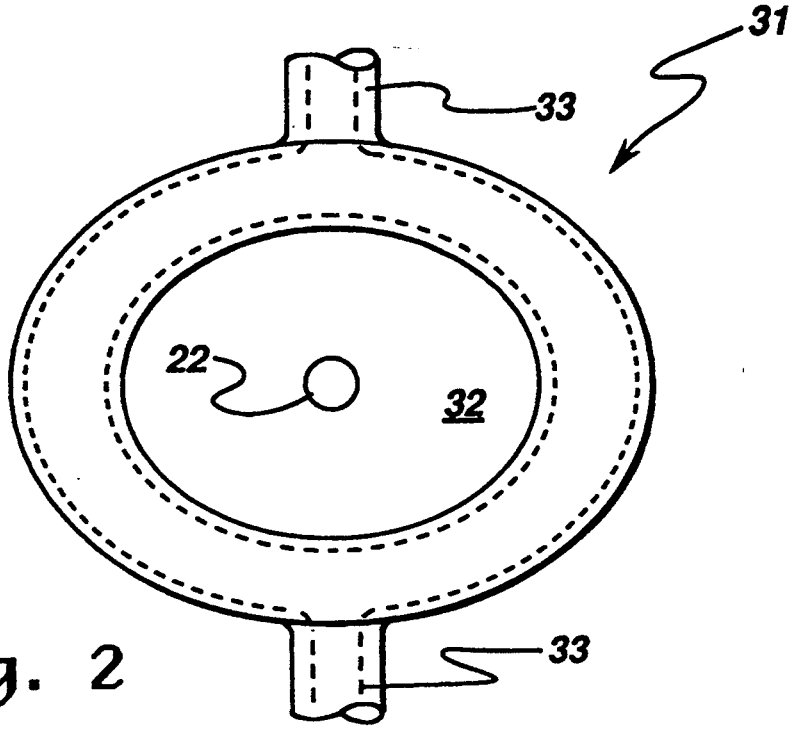
FIG. 2 is a simplified schematic illustration of one form of a non-circular atomizer of this invention.

A schematic illustration of an elongated non-circular aperture atomizer of this invention is illustrated in FIG. 2.

Referring now to FIG. 2, a representative atomizer 31 of this invention comprises a hollow tubular manifold ovately formed to define a central and elongated aperture 32, elliptical, for example, as compared to the circular aperture 24 of FIG. 1.

Atomizer 31 is fitted with an supported by diametrically opposite shafts 33 so that atomizer 31 may be rotated about the common axis of shafts 33, i.e. about a transverse and minor axis of the elliptical aperture 32. One or both shafts 33 may be hollow or tubular to also serve as gas supply conduits for atomizer 31. In the present invention, atomizer 31 of FIG. 2 replaces atomizer 23 of FIG. 1, and circular aperture 24 of FIG. 1 is replaced with the non-circular aperture 32 of FIG. 2.

The ability to selectively adjust the direction of the molten metal spray pattern 28 provides a greater choice in the position and kind of collector object which is employed. For example, in order to avoid the large bending moments in correspondingly large billets, e.g. approaching 20,000 lbs., it is desirable to orient the billet in a vertical position. Ordinarily, the usual metal melting structure such as electroslag assembly 10, FIG. 1, also occupies a vertical position and supplies a vertical melt stream 22. Accordingly, some means is required to provide extended angular adjustability for atomizer 23, FIG. 1, in order to direct spray pattern 28 at selectively advantageous angles to a vertical billet preform. The elongated, oval, or elliptical aperture in the atomizer 31 of this invention serves as this means. Very large and cumbersome preforms may be placed in a vertical position where bending moments are minimal and subjected to an advantageously directed spray pattern.

With a predetermined maximum adjustment angle of atomizer 31, metal stream 22 continues to pass through aperture 32 without atomizer/stream interference that could easily occur with a circular aperture at the same adjustment angle. A functional comparison of the two kinds of apertures is shown in FIG. 3.

Figure 3:
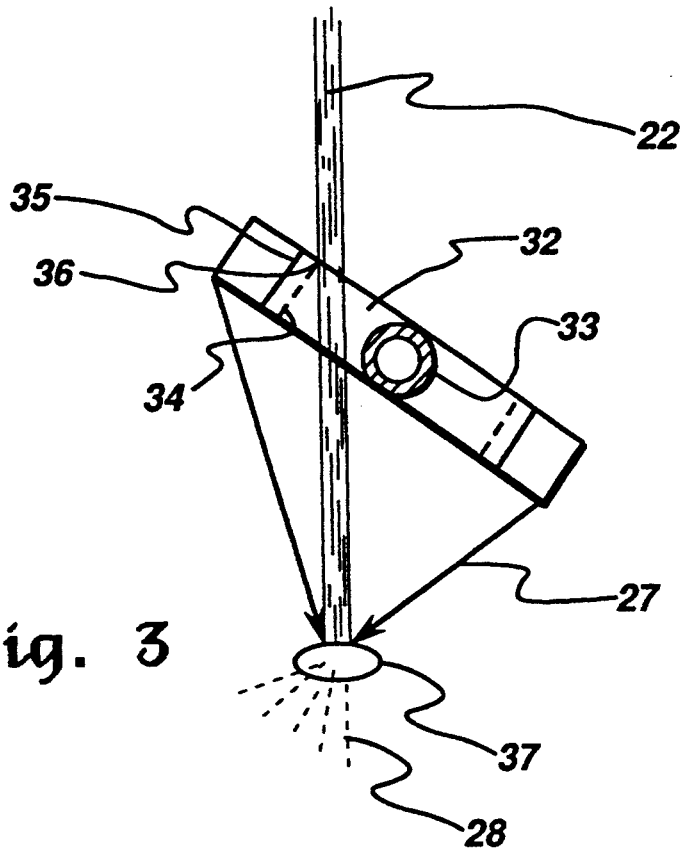
FIG. 3 is a simplified schematic functional illustration of a comparison of the circular atomizer of FIG. 1 with an elliptical atomizer of this invention.

Referring now to FIG. 3, the molten metal stream 22 of FIG. 1 passes through atomizer 31 (FIG. 2) of this invention to be converted into a molten metal plume or spray pattern 28 (FIG. 1). As illustrated in FIG. 3, the atomizer 31 of FIG. 2 is angularly adjustable about a transverse axis so that it is tilted from its horizontal position, from the viewer's perspective. Maximum adjustment angle is achieved without interference between the ring converter and the passing molten metal stream because of the elongated aperture 32 in atomizer 31 which permits an increased angular adjustment over a circular ring. For example, in FIG. 3, the dash lines 34 in atomizer ring converter 30 represent the inside diameter of a circular atomizer, e.g. atomizer 23 of FIG. 1, while the solid lines 35 represent the boundary of the major axis of the elliptical aperture 32 of atomizer 31 of this invention. The noted dash lines also show, at the maximum adjustment angle illustrated, a circular atomizer contact interference with molten metal stream 22 at region 36, clearly indicating that at the same adjustment angle, no atomizer/metal stream interference is noted for the atomizer 31 of this invention. At the same time the oval or elliptical aperture 32 provides ample clearance for molten metal stream 22 to provide a gas jet impact or atomization zone 37 for a molten metal spray pattern 28 of increased angular adjustment or deflection. As illustrated in FIG. 3, a major elongation is not required to obtain the benefits of increasing the angle of adjustment without atomizer/metal stream interference. Consequently the converter of this invention provides maximum advantage where the space available may be at a minimum. The oval or elliptical atomizer 31 (FIG. 2) is supported for angular adjustment rotation about the minor axis of an elliptical aperture 32, i.e. across the illustrated shaft supports 33 to take maximum advantage of the extended range of adjustment provided by the elliptical configuration of aperture 32. Various rotational adjustment means may be attached to one or both shafts 33 for remote electrical or mechanical operation.

Other non-circular configurations may also be employed for an atomizer ring converter. Broadly defined the noncircular elongated aperture 32, elliptical for example, comprises atomizer 31 where the radial dimension from the metal stream 22 or center of the aperture to the atomizer periphery varies as the periphery encircles the passing metal stream 22 and defines a transverse minor axis of the aperture where the clearance between the atomizer 31 and the metal stream 22 is less than the clearance between the atomizer 31 and the metal stream 22 along other axes of the aperture 32. For example, the variation of longer and shorter radial dimensions will define an axis along a shorter radial, dimension which may be referred to as a minor and transverse axis about which the converter may be angularly adjustably rotated.

This invention provides an improved spray forming atomizer for converting a molten metal stream, passing through the ring, into a molten metal spray. An elongated aperture in the converter provides increased angular adjustment of the spray pattern for increased spray deposition effectiveness. Ovate and other elongated aperture configurations may be considered to have major and minor transverse axis dimensions, one of which is longer than the other resulting in what may be defined as providing more clearance, in one direction for the passing metal stream than in the same direction if the ring were axially rotated 90°.

While this invention has been disclosed and described with respect to a preferred embodiment, it will be understood by those skilled in the art that various changes and modifications may be made without departing from the spirit and scope of the invention.

What is claimed is:

1. A molten metal spray forming atomizer comprising:

a peripheral manifold defining an aperture having a center through the manifold adapted to pass a molten metal stream through the aperture, the manifold having gas jets positioned therein surrounding the aperture at different radial dimensions from the center of the aperture, the manifold being adapted to receive a gas therein under pressure and to direct the gas through the gas jets to engage the molten metal stream after the molten metal stream has passed through the aperture so that the metal stream is atomized into a spray pattern of metal droplets; and mounting means for angular adjustment rotation of the atomizer about a transverse axis of the aperture.

2. The atomizer of claim 1 wherein the different radial dimensions define an aperture having a major and minor axis which provides a greater metal stream clearance along the major axis than along the minor axes.

3. The atomizer of claim 1 wherein the different radial dimensions define an oval aperture.

4. The atomizer of claim 1 wherein the different radial dimensions define an elliptical aperture.

5. The atomizer of claim 1 wherein the mounting means comprise at least one hollow shaft operatively connected to the manifold in gas flow relationship to supply a gas to the manifold and the gas jets.

6. The atomizer of claim 4 wherein the aperture is elliptical and the manifold is mounted for transverse rotation about the minor axis of the elliptical aperture.

7. An electroslag refining assembly including a reservoir of molten metal and an exit orifice in the reservoir through which a molten metal stream exits from the reservoir; a spray forming atomizer adapted to receive and encircle the molten metal stream to direct plural streams of gas convergently against the molten metal stream to generate a spray pattern of metal droplets, the spray forming atomizer encircling the molten metal stream at different radial dimensions from the stream to define a transverse minor axis of the aperture; and mounting means for angular adjustment rotation of the atomizer about the transverse minor axis of the aperture.

8. A molten metal spray forming atomizer comprising:

a manifold for receiving gas and having an aperture formed therein for passing a stream of molten metal therethrough;

a plurality of gas jets, operatively positioned in the manifold for directing the gas through the gas jets so as to engage the molten metal stream wherein a spray pattern of metal droplets is produced, the manifold aperture having different radial dimensions from the center thereof; and mounting means, operatively connected to the manifold, for angular adjustment about a transverse axis of the aperture.

9. The atomizer of claim 8, wherein the different radial dimensions define a manifold aperture having a major and a minor axis.

10. The atomizer of claim 9, wherein the major axis provides greater clearance between the stream and the manifold than the minor axes provides between the stream and the manifold.

11. The atomizer of claim 8, wherein the different radial dimensions define an oval manifold aperture.

12. The atomizer of claim 8, wherein the different radial dimensions define an elliptical aperture.

13. The atomizer of claim 8, wherein said the mounting means comprises:

at least one hollow shaft operatively connected to the manifold.

14. The atomizer of claim 13, wherein the at least one hollow shaft supplies the gas to the manifold.

15. The atomizer of claim 8, wherein the aperture is elliptical and the manifold is mounted for transverse rotation about the minor axis thereof.

16. A molten metal assembly comprising:

a reservoir of molten metal;

an exit orifice operatively positioned in the reservoir through which the molten metal stream exits;

a spray forming atomizer having an aperture formed therein for, encircling the stream and for directing gas jets so that the jets converge with the stream after the stream has passed through the atomizer aperture so that a pattern of droplets is generated, the atomizer having different radial dimensions that define a transverse minor axis thereof; and mounting means for angular rotation about the transverse minor axis of the atomizer.

17. The device of claim 16 wherein the molten metal assembly includes an electroslag refining assembly.

* * * * *